United States Patent [19]

Walsh et al.

[11] Patent Number: 4,858,349

[45] Date of Patent: Aug. 22, 1989

[54] ANCHORING MEMBER FOR A FABRIC STRETCHER

[76] Inventors: Brendan R. Walsh; Marietta T. Dantonio, both of 34 Carpenter Rd., Wilmington, Del. 19810

[21] Appl. No.: 202,095

[22] Filed: Jun. 2, 1988

[51] Int. Cl.[4] ..... D06C 3/08

[52] U.S. Cl. ..... 38/102.91; 24/569; 38/102.4; 160/380; 160/395; 411/544

[58] Field of Search ..... 24/569, 525, 459, 564; 160/378, 380, 382, 383, 395, 397, 392, 394; 411/10, 11, 9, 544; 38/102.7, 102.91, 102.4, 102.2; 126/438

[56] References Cited

U.S. PATENT DOCUMENTS

| | | | |
|---|---|---|---|
| 687,018 | 11/1901 | Griffin | 38/102.91 |
| 800,591 | 9/1905 | Payen | 38/102.4 |
| 917,726 | 4/1909 | Fulton | 160/395 |
| 1,248,858 | 12/1917 | Higgin | 160/392 |
| 1,461,500 | 7/1923 | Shippee | 160/395 |
| 1,772,780 | 8/1930 | Milone | 160/395 |
| 3,373,464 | 3/1968 | Ausnit | 160/382 X |
| 3,405,591 | 10/1968 | Neuschotz | 411/544 X |
| 3,987,835 | 10/1976 | Bloomfield | 160/392 |
| 4,189,856 | 2/1980 | Cookson | 38/102.4 |
| 4,322,193 | 3/1982 | Stahl | 411/544 |
| 4,539,734 | 9/1985 | Messerschmitt | 160/392 X |
| 4,716,595 | 1/1988 | Camphous | 2/46 |

FOREIGN PATENT DOCUMENTS

| | | | |
|---|---|---|---|
| 34703 | 12/1964 | Finland | 160/383 |
| 2381934 | 9/1978 | France | 160/383 |
| 1139175 | 1/1969 | United Kingdom | 411/544 |
| 1165725 | 10/1969 | United Kingdom | 160/395 |

*Primary Examiner*—Andrew M. Falik

*Attorney, Agent, or Firm*—Lipton, Famiglio & Elman

[57] ABSTRACT

A stretch frame in combination with a fabric anchoring member is formed from a lower section having a concave upper surface and a transparent flexible plastic upper section. Fabric is grasped between the sections when they are drawn compressably together. The curved surface grasps the fabric ends without damaging the fabric which is particularly advantageous with hemmed ends. The clear upper section allows the artist to visually observe the coloration of the fabric ends. The anchoring members are mounted on light weight side frame members to form a frame easily handled and placed on the artist's easel.

18 Claims, 2 Drawing Sheets

ANCHORING MEMBER FOR A FABRIC STRETCHER

BACKGROUND OF THE INVENTION

This invention relates to the art of stretching and holding fabric while a design is hand painted onto the fabric, and more particularly to an apparatus which does not damage the fabric and may be used with hemmed fabrics.

Various methods are available to produce a piece of decorated fabric which may be used to manufacture an apparel item such as a scarf. Typically the fabric material is manufactured in long bolts and the decoration applied during the manufacturing process. In such cases the material will be cut and hemmed in order to produce the final product. Another method involves the hand painting of the decoration onto a finished piece of uniformly colored material using dyes or fabric paint. This method has been popular for many years in Europe and the Orient but has only recently been introduced in any large measure in the U.S. In order to successfully paint onto the fabric, the fabric must be held taut during the painting process. Typically, this has been achieved by anchoring two of the ends of the fabric in a stretching frame which is then tensioned. Various anchoring methods have been utilized.

One method involved holding the fabric between opposing flat surfaces which are compressed together. However, great compressive force must be applied in order to keep the ends from slipping out when the frame is tensioned. Other anchoring approaches involve hooking or latching the ends of the fabric with devices such as nails which penetrate the fabric and leave holes when removed. With such devices the artist risks injury from the protruding hooks and nails. Combinations of the above two approaches are also known.

In all the prior art devices, the methods of anchoring the fabric cause damage to the fabric. Thus, it has been necessary to cut off the damages anchored ends before hemming.

In addition, the prior art frames are generally constructed from wood. These wood frames typically twist and sway when lifted upright onto an easel for convenience in painting unless constructed of very heavy wood. In such a case the weight of the wood frame becomes prohibitive. Wood frames for larger pieces of fabric are also extremely heavy and practically limit the size of fabric which can be conveniently stretched.

Another disadvantage of the prior art wood frames is that the wood anchoring members absorb the dyes. Ultimately, the absorbed dyes transfer to undyed material placed on the frame resulting in unwanted discolorations of the fabric. It is, therefore, necessary to frequently strip, sand, and refinish the wood anchoring members to prevent transfer from the old dyes.

A further disadvantage of prior art frames which clamp the fabric is that the fabric covered by the clamping members can not be seen by the artist. This results in the artist having to apply excess dye along the frame edge in order to guarantee that the clamped material will be dyed. Often, the excess dye colors the edge darker than the artist desires.

Finally, the artist frequently desires to paint prehemmed fabric since the cost of purchasing hemmed fabric is much less than the cost of hemming the fabric after painting. However, the damage done to the fabric edge by prior art devices often requires removal of the prehemmed edge and rehemming of the fabric.

BRIEF SUMMARY OF THE INVENTION

The apparatus of the present invention consists of a light weight stretching frame with anchoring members designed to grasp finished hemmed ends of fabric with sufficient force to allow proper stretching without damaging the fabric. The anchoring members consist of a solid lower member with a concave upper surface and a flexible upper member. The hem or fabric edge is captured between the members and retained as the upper member assumes a convex shape as it is tightened against the lower member. A plastic coating applied to the anchoring members prevents the painting dyes from penetrating the wood.

Accordingly, an object of this invention is to provide an apparatus for stretching and holding fabric without damaging the ends of the fabric.

A second object of this invention is to provide an apparatus for stretching and holding fabric that prevents discoloration from dyes retained by anchoring members.

A third object of the invention is to provide an apparatus for stretching and holding fabric that allows the artist to visually inspect and regulate the amount of dye, ink, or paint covering the grasped edge fabric.

A fourth object of this invention is to provide a light weight apparatus for stretching and holding fabric.

A fifth object of the invention is to provide an apparatus for stretching and holding fabric that eliminates the risk of injury from hooks, nails, and other fabric grasping devices.

A sixth object of the invention is to provide an apparatus for stretching and holding fabric that requires less fabric to be anchored than in existing apparatuses.

DETAILED DESCRIPTION OF THE INVENTION AND PREFERRED EMBODIMENTS

Figure 1:
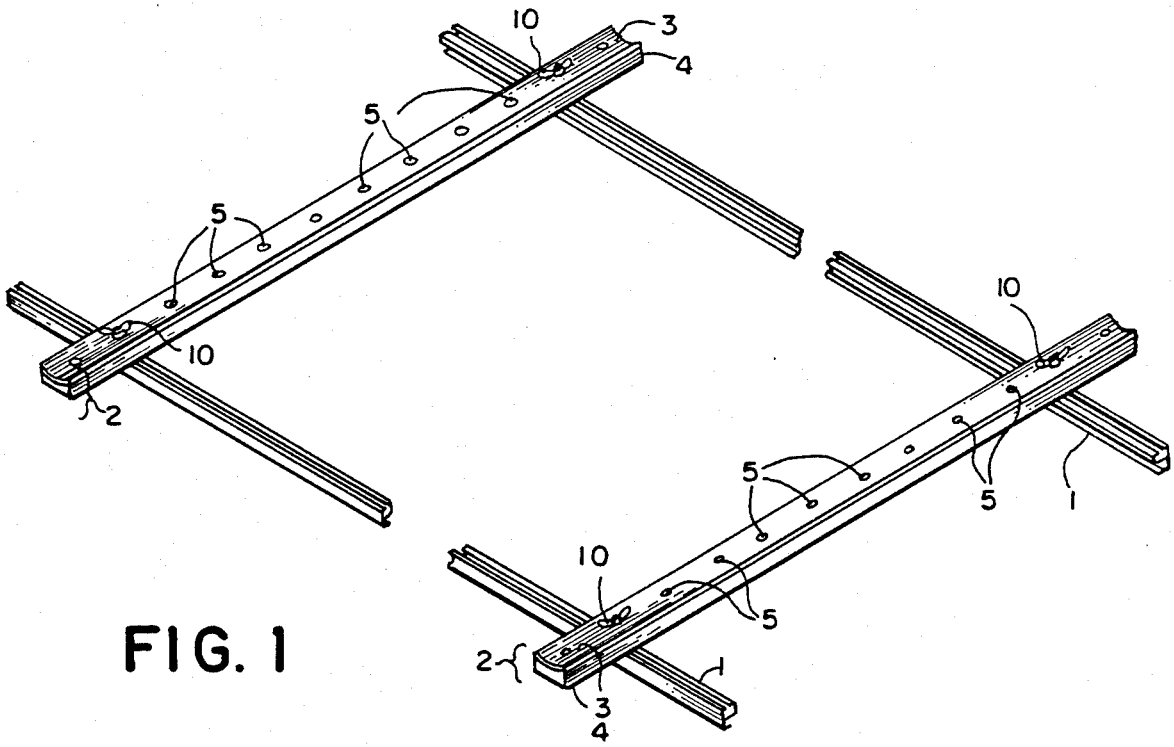
FIG. 1 is an overall view of a typical stretching frame.

FIG. 1 shows the basic components of the stretching frame of the invention. The frame is composed of long side members 1 and fabric anchoring cross members 2. The anchoring cross members 2 are themselves composed of an upper section 3 and a lower section 4. At regular intervals across the length of the cross members are indicated positions 5 where screws for fastening the upper and lower cross member sections together may be placed. In use the size of the interior rectangular space defined by the frame is adjusted so that it is slightly larger than the piece of fabric being stretched. Length adjustment is achieved by moving the cross members 2 apart or together along the length of the side members 1. Width adjustment is achieved by choosing the appropriately spaced positions 5 through which to attach the cross members 2 to the side members 1. In the preferred embodiment, the side members are formed from strong light weight metal with internal slotted channels. This results in a strong light frame which can be easily rested on an easel without twisting under its own weight. The low mass also means that larger frames for larger fabric pieces can be built and easily handled without worrying about the weight limitations of wood.

Figure 2:
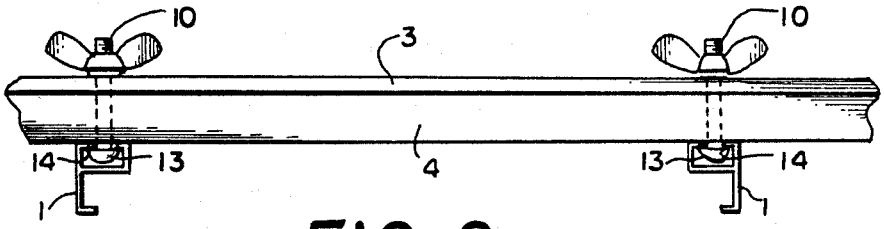
FIG. 2 is a cross sectional view of the fabric anchoring cross members showing the attachment of the cross members to the longer side members.

FIG. 2 shows a typical method of attaching the cross members 2 to the side members 1. Round head bolts 13 whose heads are wider than the channel opening 14 in side members 1 pass up through the appropriate holes in lower member 4 and upper member 3 of cross member 2 and are secured by wing nuts 10. By loosening the wing nuts and applying pressure to a cross member 2 in a direction parallel to the side members 1, the cross member 2 may be moved so as to stretch the fabric. Retightening the wing nuts secures the cross member 2 to the side members 1. Since the fabric gives as it becomes wetted during the dying process and must be frequently retensioned, this method of attaching the cross members has the advantage of ease of restretching the fabric.

Figure 3:
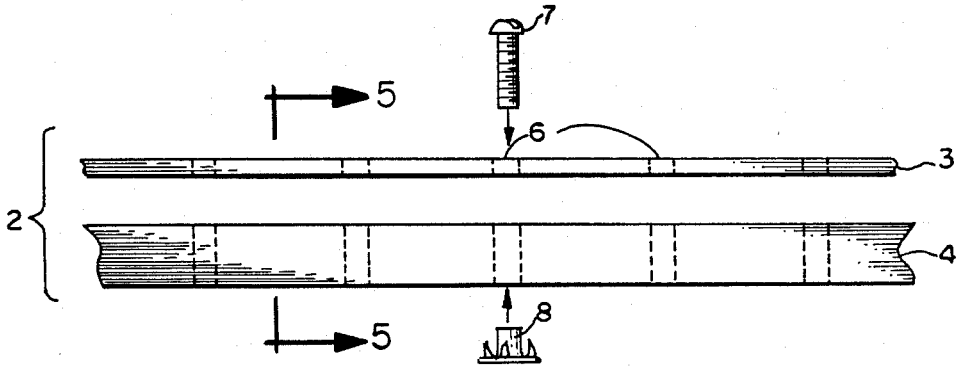
FIG. 3 is a cross sectional view of the fabric anchoring cross members showing a typical means for tightening the members together.

In FIG. 3 is shown a typical method of fastening together the upper 3 and lower 4 sections of cross members 2. In a typical embodiment, lower section 4 can be made out of wood. In such a case, a round head machine screw 7 can be guided through holes 6 and used to fasten the sections together with the aid of threaded anchor 8. Alternatively, the lower section 4 may be made of metal and the holes 6 in section 4 threaded to receive screw 7. Many other fastening methods are known and can be used.

Figure 4:
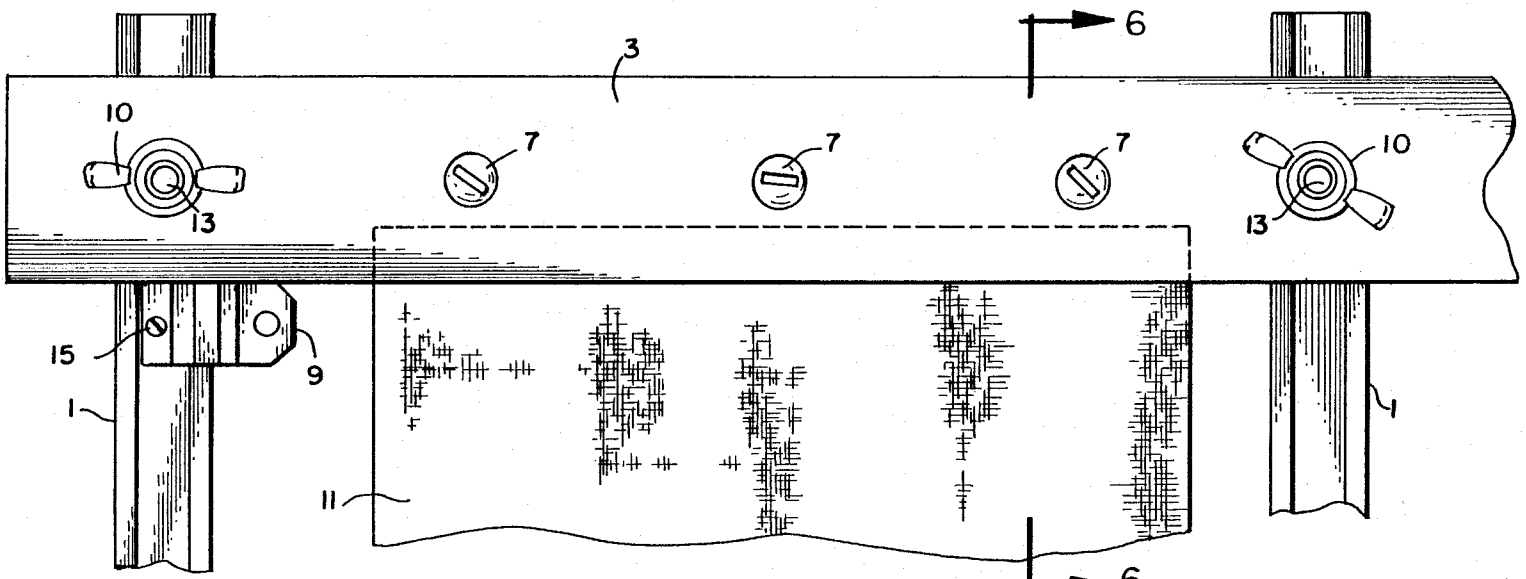
FIG. 4 is a vertical view of a fabric anchoring cross member showing the cross member fastened to the longitudinal frame member and clamping a piece of fabric.

FIG. 4 is a view from above of one end of an assembled stretcher frame shown tensioning fabric 11. The hemmed end 12 of the fabric 11 is anchored between upper section 3 and lower section 4 of the cross member which have been dawn together with screws 7. Tension has been applied to fabric 11 by sliding the cross members in opposite directions along side members 1 and securing the cross members to side members 1 with wing nuts 10 on bolts 13. In order for the stretcher to apply tension uniformly to the fabric, it is necessary that the stretcher frame be square. A right angle brace 9 is used to square the stretcher frame. Although not shown in FIG. 4, up to four right angle braces 9 could be used, one at each intersection of the cross members 2 and side members 1. The braces 9 are themselves secured to the frame side members 1 by locking screws 15 which bind against the side members 1.

Figure 5:
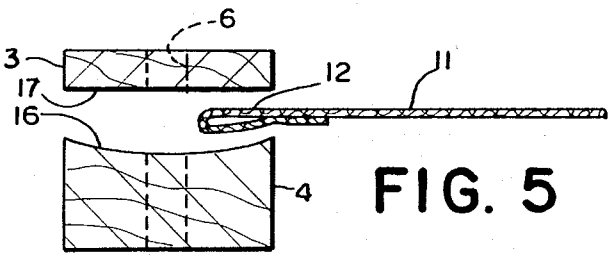
FIG. 5 is a cross sectional view end-on of a fabric anchoring cross member taken along 5-5 in FIG. 3.

FIG. 5 shows an end-on cross section of the upper 3 and lower 4 sections of cross members 2. In the preferred embodiment of the present invention, the lower section 4 is made of a rigid material, typically wood. The upper surface 16 of lower section 4 has a concave shape. Upper planer section 3 is made of a flexible material chosen so that the combination of its flexibility and thickness permits section 3 to resiliently bend or distort and conform to the shape of lower section 4 when upper section 3 is drawn into contact with lower section 4 by screws 7. In the absence of any intervening fabric, the lower surface 17 of upper section 3 assumes a matching convex downward shape when drawn against the concave upward surface 16 of lower section 4. In actual use, the end 12 of fabric 11 is placed between the two sections before they are tightened together. As flexible upper section 3 is drawn tight against lower section 4, the end 12 is grasped between the two sections and held tightly. However, since upper section 3 is flexible, as the upper and lower sections are tightened together, surface 17 does not exactly conform to the curvature of surface 16 but distorts to accommodate the thickness of the fabric end 12. In this manner, the fabric 11 is anchored tightly without damage to end 12.

A major improvement of the present invention over the prior art is the use of the curved surfaces to grasp the fabric. It has been found that less fabric needs to be caught between the anchoring sections 3 and 4 of the present invention than is required with flat surfaces. Further, using curved surfaces reduces the compressive force on the fabric required to keep the fabric from slipping out of the anchoring members. It has been found that a radius of curvature substantially about five inches works well with most fabrics. Also in the preferred embodiment the depth below the edge of the center of the curved surface of the lower section is substantially 1/16 inch.

Another major improvement of the present invention is the use of a transparent material for upper section 3. This allows the artist to visually observe the penetration of the dye into the fabric end. The artist may thus avoid excessive dying of the fabric ends by controlling the amount of dye used. It has been found that certain transparent plastics fulfill both the flexibility and transparency requirement for upper section 3 of the invention.

Figure 6:
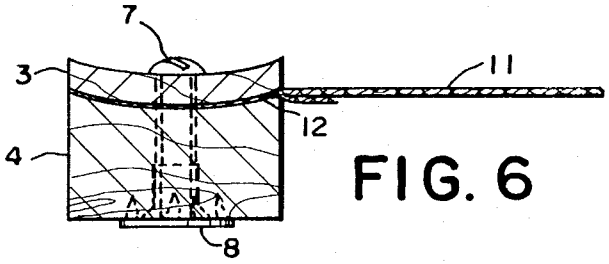
FIG. 6 is a cross sectional view end-on of the two fabric anchoring cross members taken along line 6-6, extended in FIG. 4 showing clamped fabric stretched between them.

FIG. 6 shows the fabric 11 stretched with its two hemmed ends securely anchored by the cross members of the present invention. The upper section 3 and lower section 4 are shown tightened together using screws 7 and anchors 8 wherein a perpendicular force is created to crush the resilient upper section 3. The hemmed ends 12 are shown grasped between the convex downward surfaces 17 of upper sections 3 and the concave upward surfaces 16 of lower sections 4. As shown in FIG. 4, several tightening screws 7 are used along the length of the hemmed end. The exact number required will be determined by the length of the end and the width of the frame required.

In an alternative embodiment, the upper concave surface 17 of the lower section 4 may be coated with plastic or other dye resistant compound. Such compounds, when applied to the curved surface of the anchoring member, repel the dyes or paint so that it does not penetrate and saturate the wood. Therefore, no refinishing of the wood is necessary. If a material other than plastic is chosen for upper section 3, it too may be coated to prevent penetration and saturation by the dyes or paints.

We claim:

1. A stretcher frame in combination with a fabric anchoring member, said anchoring member comprising:

(a) a rigid first section having at least one concave surface;

(b) a second section of planer flexible material resiliently compressible against the concave surface of said first section; and (c) means for applying a force in a direction substantially perpendicular to the concave surface for drawing the first and second sections compressibly together to anchor the fabric therebetween whereby the planer material is distorted to generally conform to the shape of the concave surface.

2. The anchoring member of claim 1 wherein said second flexible section is transparent.

3. The anchoring member of claim 1 wherein said second flexible section is made out of plastic.

4. The anchoring member of claim 1 wherein said first rigid section is made out of wood.

5. The wood first section of claim 4 wherein the wood is coated with dye resistant material to prevent penetration of dyes into the wood.

6. The anchoring member of claim 1 wherein the at least one concave surface of said first section has a radius of curvature of substantially five inches.

7. The anchoring member of claim 1 wherein the depth below the edge of the center of the concave surface of said first section is substantially 1/16 inch.

8. A stretching frame for tensioning fabric comprising:

(a) at least one side support member;

(b) at least two fabric anchoring members, disposed at right angles to said side members and further comprising:

(i) a rigid first section having at least one concave surface;

(ii) a planer second section of flexible material resiliently compressible against the concave surface of said first section; and (iii) means for drawing the first and second sections compressibly together, thereby securing the fabric therebetween whereby the planer material is distorted to generally conform to the shape of the concave surface;

(c) means for adjustably fastening said anchoring members to said side members; and (d) means for squaring said anchoring members to said side members.

9. The stretching frame of claim 8 wherein said second flexible section of the anchoring member is transparent.

10. The stretcher frame of claim 8 wherein said second flexible section of the anchoring member is made out of plastic.

11. The stretcher frame of claim 8 wherein said first rigid section of the anchoring member is made out of wood.

12. Said first section of the anchoring member of claim 11 wherein the wood is coated with dye resistant material to prevent penetration of dyes into the wood.

13. The stretcher frame of claim 8 wherein the side members are formed from light weight metal.

14. The light weight metal side member of claim 13 wherein the member has an enclosed channel and having one side of the channel partially open to form a slot from the exterior of the metal into the channel.

15. The stretcher frame of claim 8 wherein the means for adjustably fastening the cross members to the side members consists of a bolt and wing nut, said bolt having a head sized to slidably fit within the slot and channel of the light weight metal side members.

16. The stretcher frame of claim 8 wherein the means for compressibly drawing the first and second sections of said anchoring members together are a plurality of threaded bolts threaded into anchoring means.

17. The stretching frame of claim 8 wherein the at least one concave surface of said first section of the anchoring member has a radius of curvature of substantially five inches.

18. The stretching frame of claim 8 wherein the depth below the edge of the center of the concave surface of said first section of the anchoring member is substantially 1/16 inch.

* * * * *